US010044114B2

(12) United States Patent
Lappoehn

(10) Patent No.: US 10,044,114 B2
(45) Date of Patent: Aug. 7, 2018

(54) CONTACT ELEMENT AND PLUG CONNECTOR

(71) Applicant: ERNI Production GmbH & Co. KG, Adelberg (DE)

(72) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 15/504,719

(22) PCT Filed: Aug. 12, 2015

(86) PCT No.: PCT/DE2015/100335
§ 371 (c)(1),
(2) Date: Feb. 17, 2017

(87) PCT Pub. No.: WO2016/026483
PCT Pub. Date: Feb. 25, 2016

(65) Prior Publication Data

US 2017/0271783 A1 Sep. 21, 2017

(30) Foreign Application Priority Data

Aug. 21, 2014 (DE) ..... 10 2014 112 010
Dec. 15, 2014 (DE) ..... 10 2014 118 688

(51) Int. Cl.
*H01R 43/16* (2006.01)
*H01R 13/04* (2006.01)
(Continued)

(52) U.S. Cl.
CPC ..... *H01R 4/185* (2013.01); *H01R 13/432* (2013.01)

(58) Field of Classification Search
CPC .... H01R 13/432; H01R 13/18; H01R 13/113; H01R 13/114; H01R 13/11; H01R 13/428;
(Continued)

(56) References Cited

U.S. PATENT DOCUMENTS 4,932,877 A * 6/1990 Zinn ..... H01R 13/18 439/839
5,240,439 A * 8/1993 Egenolf ..... H01R 13/18 439/745
(Continued)

FOREIGN PATENT DOCUMENTS

DE 20 2010 011 545 U1 11/2010
DE 20 2012 002 501 U1 6/2013
(Continued)

OTHER PUBLICATIONS

International Search Report of PCT/DE2015/100335, dated Oct. 30, 2015.
(Continued)

*Primary Examiner* — Michael A Lyons
*Assistant Examiner* — Matthew T Dzierzynski
(74) *Attorney, Agent, or Firm* — Collard & Roe, P.C.

(57) ABSTRACT

A contact element for plug connectors includes plug contacts arranged on the plug side and a crimp connection arranged on the cable connection side, and at least one primary locking element and at least one secondary locking element. The plug contacts and the crimp connection are offset from one another in an axially parallel manner; the at least one primary locking element has two locking springs which act transversely in relation to the plugging direction, and which are mirror-symmetrically arranged in relation to a plugging device plane; and the at least one secondary locking element is arranged in the contact element in a mirror-symmetric
(Continued)

Figure 1:
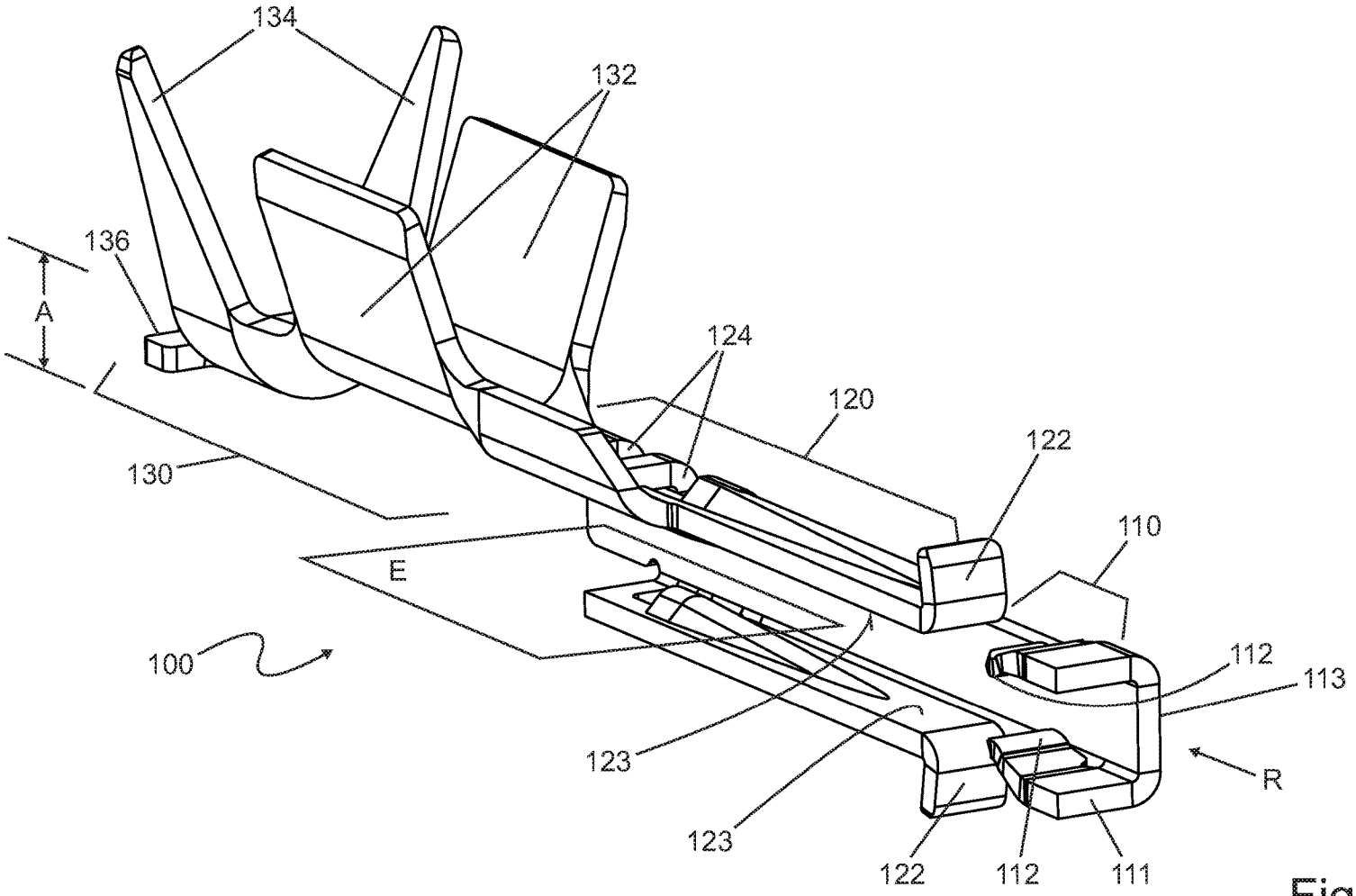

manner in relation to the plugging device plane, and has at least one secondary locking recess running transversely in relation to the plugging direction.

12 Claims, 6 Drawing Sheets

(51) Int. Cl.
*H01R 13/432* (2006.01)
*H01R 4/18* (2006.01)

(58) Field of Classification Search
CPC ..... H01R 4/185; H01R 13/03; H01R 13/20; H01R 13/434; H01R 13/4364; H01R 13/465; H01R 13/5208; H01R 13/521
See application file for complete search history.

(56) References Cited

U.S. PATENT DOCUMENTS 5,362,260 A * 11/1994 Peloza ..... H01R 13/428 439/746
5,362,262 A * 11/1994 Hotea ..... H01R 13/18 439/839
5,489,223 A * 2/1996 Faje ..... H01R 13/432 439/748
5,624,283 A * 4/1997 Hotea ..... H01R 13/18 439/745
5,664,972 A * 9/1997 Zinn ..... H01R 13/113 439/839
5,924,900 A 7/1999 Davis et al.
5,980,318 A * 11/1999 Morello ..... H01R 13/4226 439/595
5,997,363 A * 12/1999 Joly ..... H01R 13/521 439/748
6,066,007 A * 5/2000 Huang ..... H01R 13/432 439/748
6,126,495 A * 10/2000 Lolic ..... H01R 13/18 439/752.5
6,361,377 B1 * 3/2002 Saka ..... H01R 13/7032 439/745
6,679,736 B2 * 1/2004 Saka ..... H01R 13/432 439/748
6,994,596 B2 * 2/2006 Katsuma ..... H01R 13/432 439/746
7,731,550 B2 * 6/2010 Falchetti ..... H01R 13/113 439/843
8,795,007 B2 * 8/2014 Itou ..... H01R 13/114 439/852
9,136,644 B2 * 9/2015 Yu ..... H01R 13/64
9,142,917 B2 * 9/2015 Yu ..... H01R 13/631
9,312,615 B2 * 4/2016 Kroeckel ..... H01R 12/721
2002/0146943 A1 10/2002 Saka
2012/0309219 A1 * 12/2012 Hiraishi ..... H01R 13/4365 439/352

FOREIGN PATENT DOCUMENTS

EP 1 077 513 A1 2/2001
EP 2 575 215 A1 4/2013
GB 1 100 657 A 1/1968
NO 2004/107505 A1 12/2004

OTHER PUBLICATIONS

German Office Action dated Aug. 11, 2015 in German Application No. 10 2014 118 688.5 with English translation of relevant parts.
German Office Action dated Oct. 11, 2016 in German Application No. 10 2014 118 688.5 with English translation of relevant parts.

* cited by examiner

CONTACT ELEMENT AND PLUG CONNECTOR

CROSS REFERENCE TO RELATED APPLICATIONS

This application is the National Stage of PCT/DE2015/100335 filed on Aug. 12, 2015, which claims priority under 35 U.S.C. § 119 of German Application No. 10 2014 112 010.8 filed on Aug. 21, 2014 and German Application No. 10 2014 118 688.5 filed on Dec. 15, 2014, the disclosures of which are incorporated by reference. The international application under PCT article 21(2) was not published in English.

The invention relates to a contact element for plug connectors having plug contacts arranged on the plug side and a crimp connection arranged on the cable side. The invention further relates to a plug connector having at least one such contact element arranged in a plug connector housing.

PRIOR ART

A plug connector of this type emerges from DE 20 2010 011 545 U1. This plug connector has contact elements having crimp connections arranged on the cable connection side, said crimp connections being provided in each case with a primary locking element and a secondary locking element. Every contact elements serves as a spring contact and is, in addition, provided to contact an individual cable by crimping and to fix it in the contact element. Each of these contact elements is arranged in a plug connector housing, wherein the contact elements are located one alongside the other. Such plug connectors are used, for example, in automobile manufacture. They serve to contact individual cables in a plug connector to several contact elements that are located one alongside the other or one above the other. Contacting of individual cables in a common plug connector is necessary in automobile manufacture because outlets for individual cables from a common cable harness are required at different points.

Especially in automobile manufacture, such plug connectors are exposed to high loads, for example vibrating loads and suchlike. Crimp connections withstand these loads very well. Because of the installation space that crimp connections occupy, it is, however, not easily possible to construct these connectors very compactly. The spacing of the contact elements in the plug connector housing is essentially determined by the measurements/diameter of the crimp connections.

DISCLOSURE OF THE INVENTION

The contact elements according to the invention as described herein and the plug connector according to the invention, in which such contact elements are arranged in a plug connector housing, having the features described herein enable, in comparison, a very compact installation in a very advantageous manner and a further decrease in size of such plug connectors and thus an increase in the number of contact elements to be arranged in such a plug connector and thus an increase in the number of contact elements that can be arranged in such a plug connector and thus an increase in the number of cables to contact, which end in the plug connector. Furthermore, a two-row implementation of such a plug system is only possible through this.

According to the invention it is here provided that the plug contacts and the crimp connection are offset axially parallel to each other and that the at least one primary locking element has two locking springs which act transversely relative to the plugging direction and are arranged to be mirror-symmetrical relative to a plugging means plane and that the at least one secondary locking element has at least one secondary locking indent that is arranged in the contact element to be transverse relative to the plugging direction and mirror-symmetrical relative to a plugging means plane. By the axially parallel offset arrangement of the plug contact and the crimp connection and the primary locking element and secondary locking element that are arranged to be mirror-symmetrical relative to the plug means plane working together, it is possible to position the plug contacts respectively rotated by 180° relative to one another one alongside the other in the plug. As a result of this, a two-row arrangement of the plug contacts in a plug connector is possible. In this case, the plug contacts are on one plane and two such planes of adjacent plug contacts are located one above the other. The plug contacts and thus the crimp connections are in one plane rotated by 180° relative to the other plane.

According to an advantageous embodiment of a plug connector according to the invention, it is provided that the plug contacts in the plug connector are positioned, in each case alternating with 180° rotation relative to one another, one alongside the other wherein the crimp connections respectively lying on top of one another and below one another can overlap in the mounted state transversely (perpendicularly) relative to the plugging direction. This enables the plug contacts to be arranged in one row, wherein the plug contacts can lie substantially closer to one another than in plugs known from the prior art, since the crimp connections are no longer "mutually disturbed" as it were because of their alternating arrangement in the plug connector housing, since they are in each case offset relative to one another and can be so close to one another that the crimp connections slightly overlap on different planes. It is also only possible with this arrangement to form such plug systems in a two-row design. This is made possible by the possibility of mounting plug connectors in positions rotated by 180°.

Further advantageous developments and embodiments of the contact element according to the invention and the plug connector according to the invention are also described herein.

Thus it is advantageously provided that the plug contacts and the crimping connection are offset relative to one another by a measure of length that substantially corresponds at least to the largest measurement perpendicular to the plugging direction or to the diameter of the crimping connection. In this way, the slightly overlapping arrangement of the contact elements arranged in planes offset to one another as described above is very advantageously possible.

Every contact element also very advantageously has a crimp-arresting element on the cable connection side following the crimp connection, said crimp-arresting element coming to rest in an indent that is mirror-inverted relative to it in the plug connector housing after mounting the contact element in the plug connector housing by exerting pretension. In this way, the contact element is fixed in the plug connector housing and it is thus achieved that even considerable vibrating loads, like the ones that can occur in vehicles, do not lead to a break, for example, of the transition region between the contact elements and the crimp region or to contact corrosion of a copper conductor in the crimp connection that has an insulating effect.

It is thus very advantageously provided that the crimp-arresting element is arranged on the lower edge of the crimp connection. On the lower edge here means lying substantially on the plane of opened crimp wings.

The plug contacts formed as spring contacts are arranged on a U-bracket arranged on the plug contact side, they taper inwards, are formed springily and point in the direction of the cable connection side. This formation provides a simple and effective reception of blade contact elements, and indeed in such a way that an actuation of the primary lock is also simultaneously implemented in the manner that will be subsequently described in more detail.

The locking springs preferably have blade contact support surfaces on their side facing towards the plugging means plane. These serve to effectively prevent the locking springs from unlatching from the openings provided in the plug connector housing, since the blade contact support surfaces abut the blade contact elements and do not allow any movement of the locking springs in the direction of the plugging means plane in the plugged state of the blade contact elements.

The secondary locking cams provided in the housing preferably have an excess length relative to the secondary locking indents such that, when the locking cams engage with the secondary locking indents, this causes the locking cams to wedge in the secondary locking indents. By the cams completely engaging in the secondary locking indents, the contact element is secured in the plug connector housing.

SHORT DESCRIPTION OF THE DRAWINGS

Exemplary embodiments of the invention are depicted in the drawings and are described in more detail in the description below.

Figure 2:
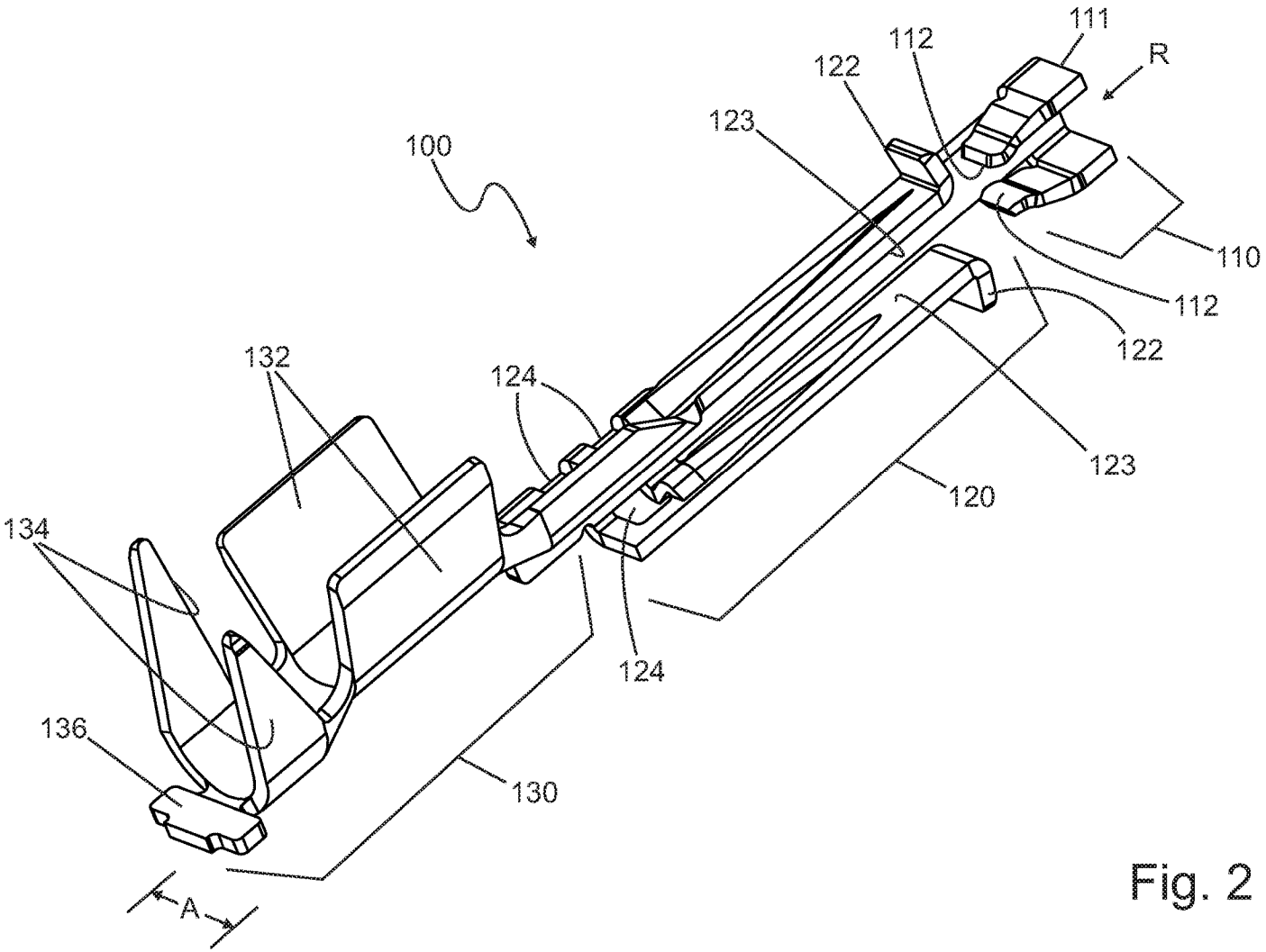
Figure 3:
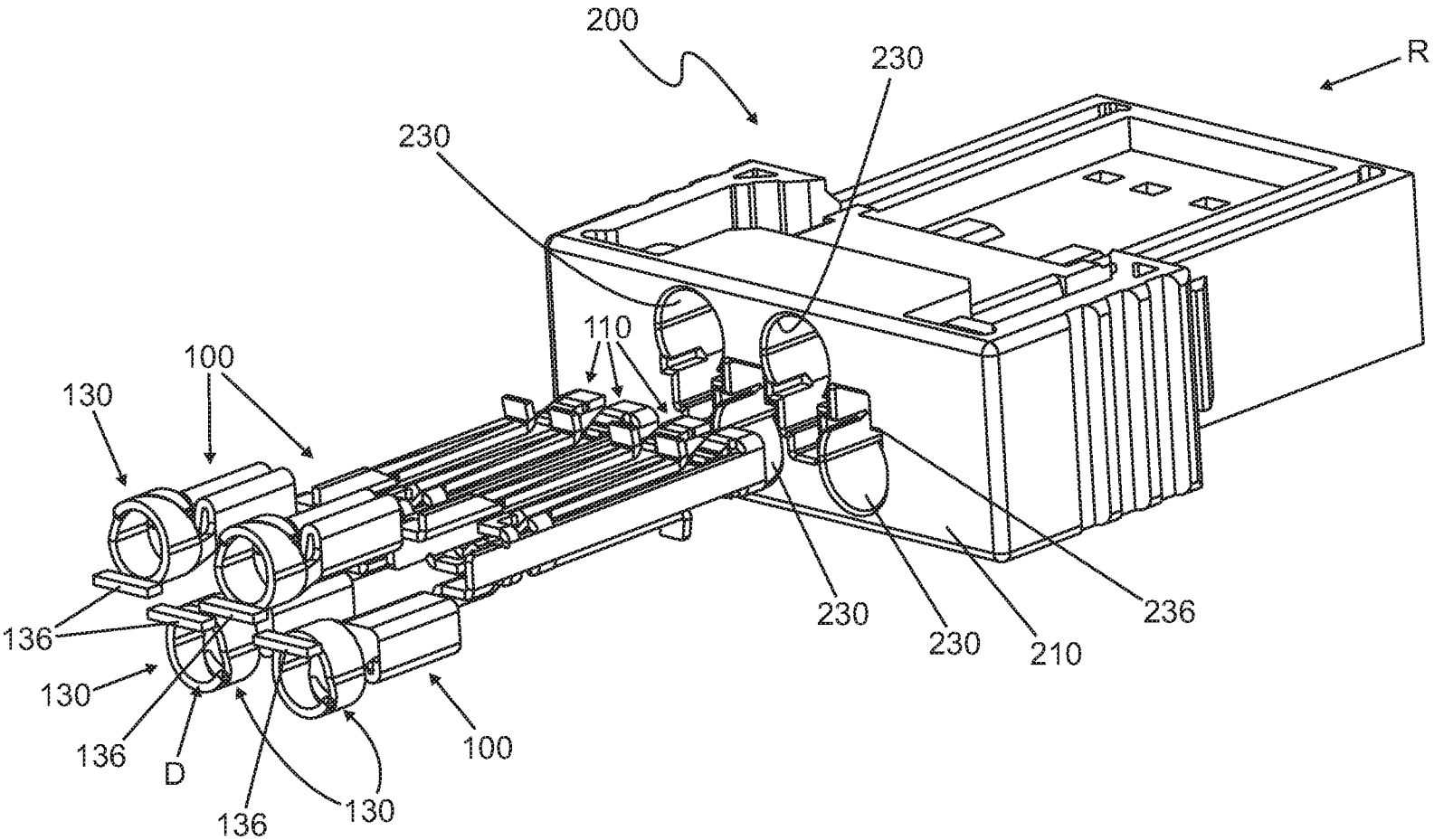
Figure 4:
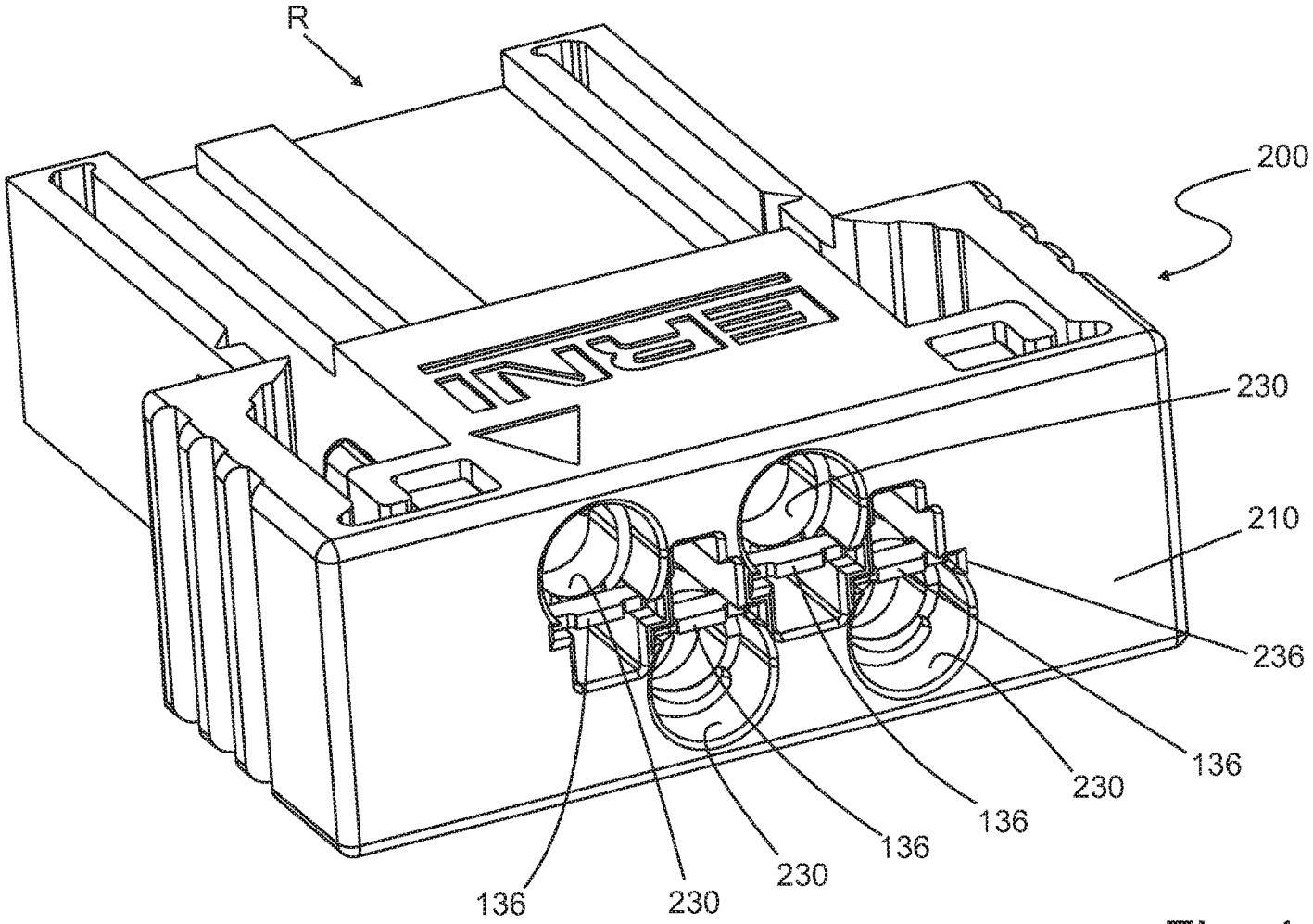
Figure 5:
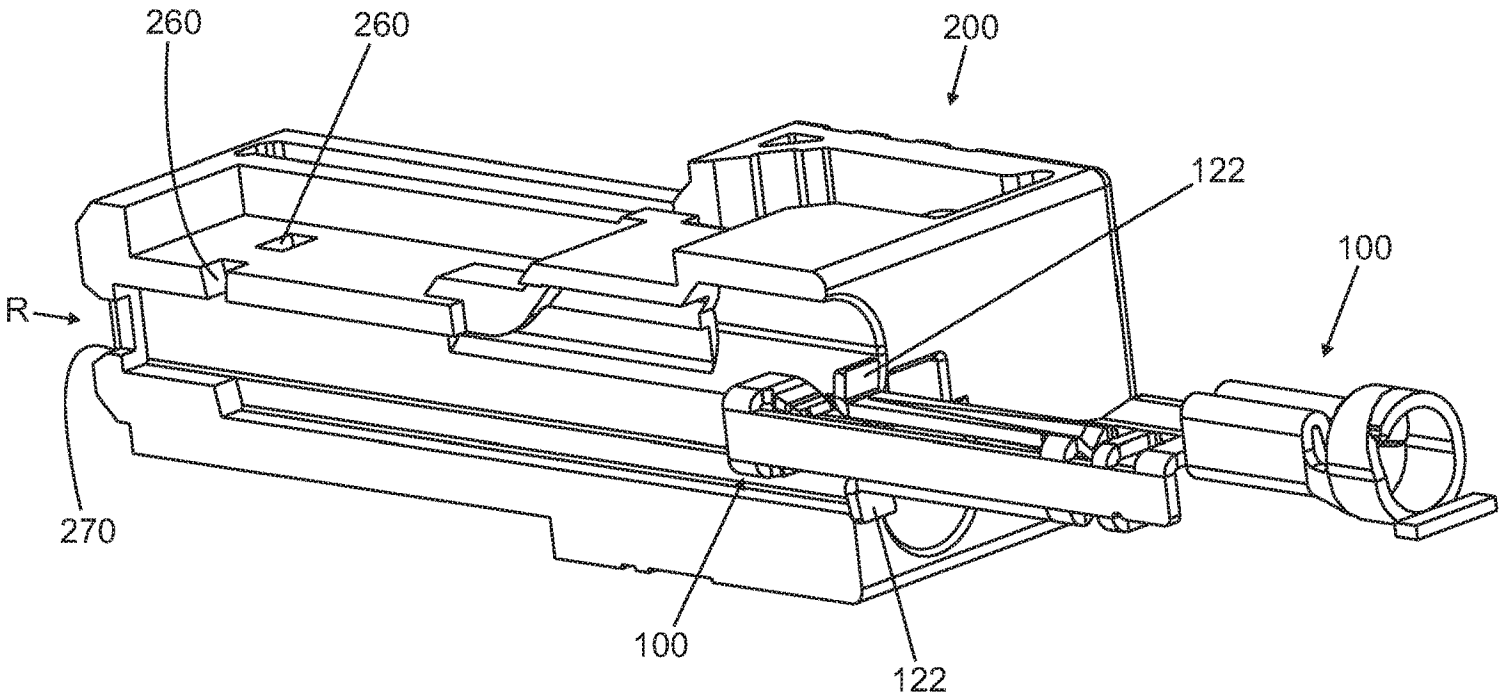
Figure 6:
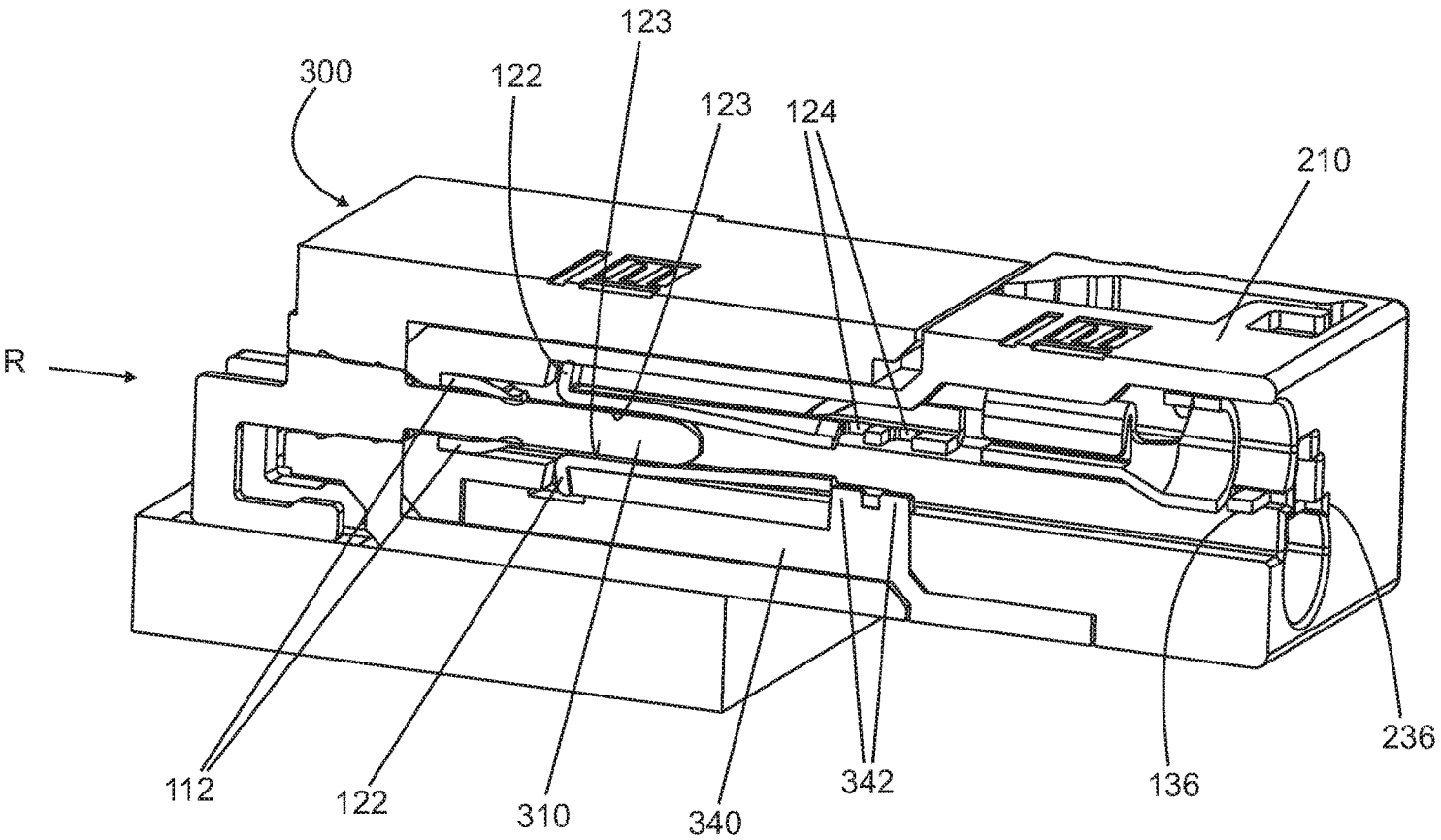

Here are shown:

FIG. 1 an isometric depiction of a contact element according to the invention from a first viewing direction;

FIG. 2 the contact element depicted in FIG. 1 in an isometric depiction from a different viewing direction;

FIG. 3 an isometric depiction of a plug connector according to the invention before mounting the contact elements;

FIG. 4 an isometric depiction of a plug connector according to the invention after mounting the contact elements;

FIG. 5 an isometric sectional depiction to explain mounting a contact element in a plug connector housing and FIG. 6 an isometric sectional depiction of a plug connector according to the invention in the plugged state with a further plug connector fitting to it.

DESCRIPTION OF THE EXEMPLARY EMBODIMENTS

A contact element labelled as a whole with 100 has a contact region 110, a locking region 120 and a crimp region 130. The contact region 110 substantially consists of a U-shaped, bent bracket 111, on which plug contacts 112 that taper inwards in plugging direction, are formed springily and point in the direction of the cable close side, i.e. of the crimp region 130, are arranged. These plug contacts 112 arranged on the plug side serve to receive a blade contact element 310 (see FIG. 6).

The locking region 120 following the contact region 110 has primary locking elements and secondary locking elements. The primary locking elements are two locking springs 122 that act transversely relative to the plugging direction R and are arranged mirror-symmetrically relative to a plugging means plane E, which extends perpendicularly from a plugging base part of the bracket 113 in the middle between the plug contacts 112, said locking springs engaging with corresponding indents 260 in a plug connector housing in the mounted state and being held there by their spring effect (see FIG. 1, FIG. 5).

These locking springs 122 form the primary lock. A secondary lock is connected to this on the side of the locking region 120 facing towards the crimp region 130, said secondary lock being formed by secondary locking indents 124 among other things. These secondary locking indents 124 are also arranged to be mirror-symmetrical relative to plane E.

Because of the mirror-symmetrical arrangement of both the locking springs 122 of the primary locking element and of the secondary locking indents 124 of the secondary locking element, it is possible to also use the contact element rotated by 180° without installation changes. In this case, the upper and lower locking springs 122 and the upper and lower secondary locking indents 124 change their positions. The U-bracket 111 is similarly rotated by 180° such that, in FIG. 1, the base surface 113 is arranged on the left side instead of the right, when viewed in the plugging direction R. The plugging contacts 112 are similarly formed to be mirror-symmetrical to plane E and arranged such that plugging is possible in both positions of the contact element 100 rotated by 180°. In both positions of the contact element 100, in each case rotated by 180°, the full function of the primary locking element and the secondary locking element is also guaranteed. Along with this mirror-symmetrical arrangement of the plug contacts 112, the locking springs 122 of the primary locking element and the secondary locking indents 124 of the secondary locking element, it is provided that the crimp region 130 is offset to be axially parallel by a distance A relative to the locking region 120 and contact region 110. This distance A substantially corresponds at least to the diameter D or to the largest measurement perpendicular to the plugging direction of a crimp connection in the crimped state (cf. FIG. 3, FIG. 4). The crimp connection has, in an inherently known manner, crimp wings 132 for crimping strands and clamp wings 134 for clamping the insulating shell of a cable (not shown) for cable relief. A crimp-arresting element 136 is connected to the clamp wings 134, said crimp-arresting element being substantially T-shaped and lying on the plane of the completely flatly curved crimp wings 132 or clamp wings 134. The function of this arresting element 136 is described in more detail below.

Such contact elements are arranged in a plug connector, which is labelled as a whole as 200. For this, openings 230 adjusted to the contact elements 100 are provided in a plug connector housing 210, which serve for the reception and positioning of the contact elements 100 (see FIGS. 3-6). For this, the contact elements 100 are pushed into the openings 230 from a front side of the housing 210 and are fixed there because of the locking elements, as is explained in greater detail below in connection with FIG. 5 and FIG. 6. According to the invention it is now provided that the indents 230 are arranged in the plug connector housing 210 in such a way that the contact elements 100 are positioned one alongside the other, in each case alternating with 180° rotation relative to one another. As FIG. 3 shows, such a design enables the arrangement of contact regions 110 lying very close to one another in one row. This is possible because the crimp regions 130 are not located one alongside the other, but rather lie alternately one on top of the other in an alternating manner, wherein the crimp regions 130 can overlap because of being arranged one on top of the other and only thus allow a close arrangement of the contact regions 110. By doing so it is also possible to implement plug connectors having a two-row implementation of the contact elements. In this case, the contact elements lie one on top of the other, wherein the contact elements 100 are arranged in rows lying one on top of the other, in each case rotated by 180° relative to one another. In order to be able to implement such an alternating arrangement of contact elements, the locking elements, namely the primary locking and secondary locking elements, have to be formed mirror-symmetrically relative to plane E, in order to be able to arrange one single contact element into two different positions rotated by 180° relative to each other in the plug connector housing 210.

FIG. 5 shows the moment of pushing a contact element 100 into the plug connector housing 200. The contact regions 110 having the two plug contacts 112 in each case, which taper in the plugging direction R and are formed springily, are pushed up to an opening 270 of the housing 200. Only in the completely pushed in state does one of the two locking springs 122 of the primary locking element spring into an opening 260 thus provided in the housing. The adjacent contact element is rotated by 180° and with this the other locking spring 122 springs into the opening 260. With adjacent contact elements 100, the upper or lower locking springs 122 of the primary locking elements therefore engage with the opening 260, in each case alternating in terms of the plane E.

FIG. 6 shows the plug connector 200 with mounted contact element 100 in conjunction with a further fitting plug connector 300 in an isometric sectional depiction. The further plug connector 300 has blade contacts 310, of which only one single contact can be seen in FIG. 6. The blade contact 310 engages with the plug contacts 112 by producing an electrical contact. At the same time, it protrudes so deep into the locking region 120 that the locking springs 122 that form the primary locking element and run transversely to the plugging direction R fix a resting position in an opening 260 of the plug connector housing 210.

After a blade contact element or blade contact 310 has been pushed into the spring contact element 100, as is schematically depicted in FIG. 6, the locking spring 122 is effectively and safely prevented from unlatching, meaning the resting hook of the locking spring 122 unlatching from the corresponding opening 260 of the plug connector housing 210 can take place. In this case, the locking springs 122 are supported on the blade contacts 310 by their support surfaces 123 facing towards the blade contact 310 such that, in the plugged state, the locking springs 122 unlatching is prevented.

A further secondary locking element 340 is provided in the form of secondary locking cams 342, which engage with the secondary locking indents 124. It also applies here that the contact elements 100 can be alternatingly arranged in two different positions rotated by 180° because of the mirror-symmetrical arrangement of the secondary locking indents 124 in terms of plane E, wherein one and the same secondary locking element 340 engages with the secondary locking cams 342, once with the one (upper) secondary locking indents and another time with the other (lower) secondary locking indents 124, which are arranged mirror-symmetrically relative to plane E. The secondary locking cams 342 have a small excess length in comparison to the secondary locking indents 124. By doing so, a pre-tensioned fixing of the contact element 100 in the plug connector housing 200 is possible in the plugged state.

As emerges from FIG. 4 and FIG. 6, indents 236 are provided in the housing 200 for the crimp-arresting element 136, said indents being adjusted to the crimp-arresting element 136 and indeed in such a way that fixing the crimp regions 130 in the plug connector housing 200 is implemented by the arrangement of the crimp-arresting element 136, which is arranged on the lower edge of the crimping connection, in these indents 236. This fixing prevents disruptive contact corrosion from arising and thus an interruption of the electrical contact by resistance increase, or even prevents the contact element 100 from breaking during a vibration, to which such a plug, e.g. in a motor vehicle, is subjected.

The invention claimed is:

1. Contact element for a plug connector having plug contacts arranged on the plug side and a crimp connection arranged on the cable connection side and having at least one primary locking element and having at least one secondary locking element, wherein the at least one primary locking element has two locking springs that act transversely relative to the plugging direction and are arranged mirror-symmetrically relative to a plugging plane, wherein the at least one secondary locking element has at least two secondary locking indents respectively running transverse relative to the plugging direction and arranged in the contact element to be mirror-symmetrical relative to the plugging plane, wherein a crimped cable axis of the crimp connection is axially parallel offset from the plugging plane.

2. Contact element according to claim 1, wherein the plug contacts and the crimp connection are offset relative to each other by a length measurement which substantially corresponds at least to the diameter of the closed crimp connection or to the largest measurement perpendicular to the plugging direction of the closed crimp connection.

3. Contact element according to claim 1, wherein a crimp-arresting element follows the crimp connection on the cable connection side.

4. Contact element according to claim 3, wherein the crimp-arresting element is arranged on the lower edge of the crimp connection on the plane of the completely opened crimp wings or completely opened clamp wings.

5. Contact element according to claim 1, wherein the plug contacts are arranged on a U-bracket arranged on the plug contact side in such a way that they taper inwards, are formed springily and point in the direction of the cable contact side.

6. Contact element according to claim 1, wherein the locking springs have blade contact support surfaces on their side facing the plugging plane.

7. Plug connector having at least one contact element according to claim 1 arranged in a plug connector housing, wherein openings for the locking springs of the primary locking elements are provided in the plug connector housing, wherein secondary locking cams are provided in the plug connector housing which engage with the secondary locking indents of the secondary locking element, wherein indents adjusted to the contact elements are arranged in the plug connector housing in such a way that the contact elements are positioned in the mounted state in the indents and are fixed by the primary and secondary locking elements, and wherein the indents are arranged in the plug connector housing in such a way that the contact elements, respectively rotated by 180° relative to one another, are positioned one alongside the other.

8. Plug connector housing according to claim 7, wherein the contact elements are positioned, in each case alternating with 180° rotation relative to one another, one alongside the other, and wherein the crimp connections lying in each case one on top of the other and one below the other overlap transversely relative to the plugging direction.

9. Plug connector according to claim 7, wherein the secondary locking cams have an excess length relative to the secondary locking indents such that, when the locking cams engage with the secondary locking indents, this causes the locking cams to wedge in the secondary locking indents.

10. Plug connector according to claim 7, wherein the crimp-arresting element comes to rest in an indent that is mirror-inverted relative to the crimp-arresting element in the plug connector housing, in particular by exerting pretension by moving the contact element parallel to the plugging direction.

11. Contact element according to claim 1, wherein in a completely open state of the crimp connection, a crimp opening of the crimp connection faces away from the plugging plane.

12. Contact element according to claim 1, wherein the at least one secondary locking element has four secondary locking indents respectively running transverse relative to the plugging direction and arranged in the contact element to be mirror-symmetrical relative to the plugging plane.

* * * * *